US005103921A

United States Patent [19]

Zeer et al.

[11] Patent Number: 5,103,921

[45] Date of Patent: Apr. 14, 1992

[54] CORING ASSEMBLY FOR MOUNTING ON THE END OF A DRILL STRING

[75] Inventors: Robert L. Zeer; Alex Mihai, both of Calgary, Canada

[73] Assignee: Sidetrack Coring Systems Inc., Calgary, Canada

[21] Appl. No.: 666,632

[22] Filed: Mar. 8, 1991

[51] Int. Cl.[5] ..... E21B 7/06; E21B 25/16

[52] U.S. Cl. ..... 175/81; 175/230; 175/244; 175/267; 175/284

[58] Field of Search ..... 175/77, 78, 79, 81, 175/82, 83, 230, 244, 250, 267, 272, 292, 403, 284, 285, 286

[56] References Cited

U.S. PATENT DOCUMENTS

| | | | |
|---|---|---|---|
| 1,750,953 | 3/1930 | Boynton | 175/286 X |
| 2,061,317 | 11/1936 | Brack | 175/82 X |
| 2,709,574 | 5/1955 | Arutunoff | 175/250 X |
| 3,175,392 | 3/1965 | Tharalson et al. | 175/78 X |
| 3,572,450 | 3/1971 | Thompson | 175/81 X |
| 4,978,258 | 12/1990 | Lins | 175/292 X |

*Primary Examiner*—William P. Neuder

*Attorney, Agent, or Firm*—Fleit, Jacobson, Cohn, Price, Holman & Stern

[57] ABSTRACT

There is provided a new and useful coring assembly for mounting on the end of a drill string and comprising a core barrel; abrading means on at least a part of the core barrel; a reaming collar mounted about a lower section of the core barrel and selectable between a first condition in which the collar is rotatable with the barrel and a second condition in which the collar is rotatable relative to and slidable longitudinally relative to the core barrel; a housing suspended from the core barrel; a deflection crank extending between the housing and the core barrel; and means within the housing for transferring power from a power source to the crank for selectively rotating the crank for moving the core barrel between a first position in which the core barrel and the housing are aligned and a second position in which the barrel and the housing are not aligned.

18 Claims, 2 Drawing Sheets

CORING ASSEMBLY FOR MOUNTING ON THE END OF A DRILL STRING

This application relates to a coring assembly for obtaining core samples from existing bore holes at levels intermediate ground level and the bottom of the hole

BACKGROUND OF THE INVENTION

During and after the drilling of bore holes, as, for example, in the oil and gas industry, core samples are utilized to obtain accurate information relative to formations containing resources of interest. Such samples are commonly taken at the bottom of a bore hole prior to continuing the boring process through a formation of interest.

It is also very advantageous to be able to obtain substantial core samples at various levels in a hole, after the hole has been drilled and logged. After drilling, examination of open hole logs and bore hole cuttings can identify levels from which such additional core samples would be useful.

There are currently a number of methods available for obtaining samples from formations at various levels in an open hole. All such currently available methods have serious shortcomings. For example, in many cases only very small diameter cores can be obtained. In other methods multiple trips into and out of the hole are required for each sample With many methods the cores are short and/or do not represent the lithology changes along the bore hole.

The present invention is directed toward a method and apparatus for obtaining a core sample of sufficient length and diameter from the formation generally along the axis of bore hole, at a selected level in an existing bore hole and requires only a single trip into the hole.

PRIOR ART

The following references are of interest but do not provide the advantages of the present case:

U.S. Pat. No. 2,511,508
U.S. Pat. No. 2,558,452
U.S. Pat. No. 2,571,644
U.S. Pat. No. 2,852,230
U.S. Pat. No. 3,353,612
U.S. Pat. No. 3,421,590
U.S. Pat. No. 4,007,797
U.S. Pat. No. 4,523,652

BRIEF SUMMARY OF THE INVENTION

It has now been determined that a reaming tool can be combined with a core barrel having an abrasive on a part of the exterior, to mill a pocket into the side of the bore hole at a desired level and then to take a core sample down along and outside the bore hole.

Thus, the invention provides a coring assembly for mounting on the end of a drill string and comprising a core barrel; abrading means on at least a part of the core barrel; a reaming collar mounted about a lower section of the core barrel and selectable between a first condition in which the collar is rotatable with the barrel and a second condition in which the collar is rotatable relative to and slidable longitudinally relative to the core barrel; a housing suspended from the core barrel; a deflection crank extending between the housing and the core barrel; and means within the housing for transferring power from a power source to the crank for selectively rotating the crank for moving the core barrel between a first position in which the core barrel and the housing are aligned and a second position in which the barrel and the housing are not aligned.

BRIEF DESCRIPTION OF THE DRAWINGS

In drawings which illustrate embodiments of the invention.

Figure 1:
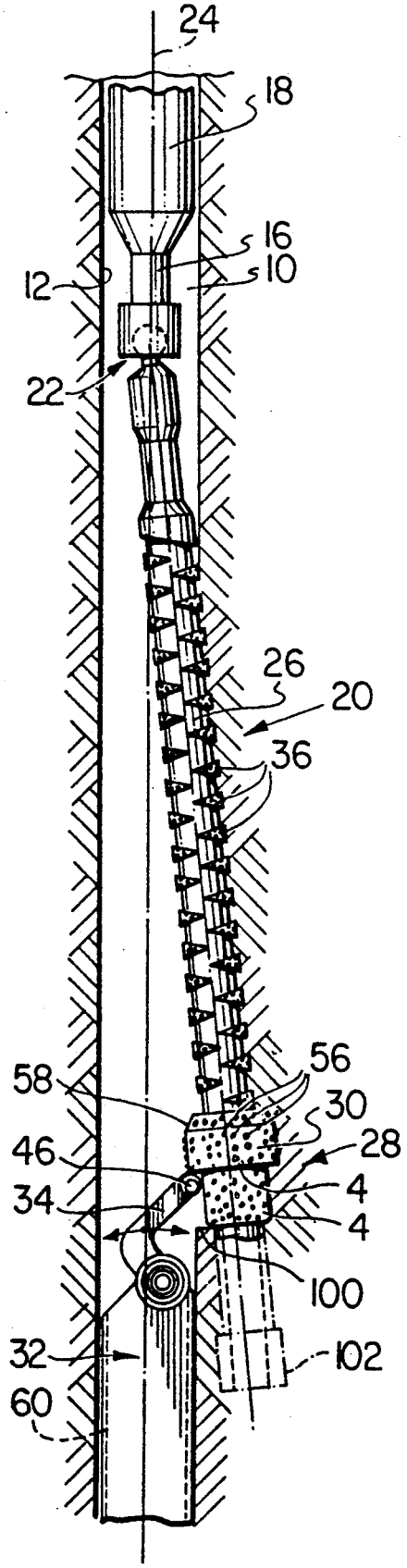
FIG. 1 is an elevation of the assembly in a bore hole after milling of a pocket.

While the invention will be described in conjunction with illustrated embodiments, it will be understood that it is not intended to limit the invention to such embodiments. On the contrary, it is intended to cover alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

A section of a pre-existing bore hole 10 has a side wall 12. As illustrated in FIG. 1 the end 16 of drill string 18 is positioned in bore hole 10.

The coring assembly 20 is secured to end 16 of drill string 18. In the preferred configuration the means of securing coring assembly 20 to end 16 of drill string 18 is by means of a universal joint 22. The universal joint permits the coring assembly 20 to be rotated in the normal manner by the drill string 18 and also to operate out of the axis 24 of the drill string 18 and of the bore hole 10.

In addition to the preferred universal joint 22, the coring assembly comprises a core barrel 26, a core bit 28, a reaming collar 30, a power unit 32 and, between core barrel 26 and power unit 32, the deflection crank 34.

The core barrel 26 is provided with abrading means 36 on at least a part of the core barrel 26. In the preferred embodiment the abrading means 36 is provided in a pre-selected pattern over substantially the length of core barrel 26. The preferred pattern is such as to provide a double spiral effect on the outside of core barrel 26. The abrading means may comprise a brass/carbide mixture applied in known manner to the core barrel 26. Any other suitable milling material which would abrade most types of rock would be acceptable.

The core bit 28 is secured to core barrel 26 in conventional manner.

A cylindrical guide ring 38 is in sliding relationship with the lower end 27 of core barrel 26 through bushing 40. Bushing 40 is positioned by a pair of spacer rings 41. The ring 38, bushing 40 and rings 41 are supported against the top 42 of bit 28.

The guide ring 38 is secured to a hinge 46. The deflection crank 34 is also secured to hinge 46 for rotation relative to guide ring 38. Crank 34 and power unit 32 are actually suspended from hinge 46 and thus through guide ring 38 from core barrel 26.

The reaming collar 30 rides on the guide ring 38 with the intervention of a bearing 48. In order to secure ring 38 and collar 30 axially relative to bit 28, for insertion into the hole, the collar 30 and core barrel 26 are provided with threaded bore 51 and slot 50 respectively into which the shear pin 52 is inserted.

While the core barrel 26 and reaming collar 30 are held by the shear pin 52 they are also interlocked by a short splined section 53. This allows the dependant transfer of torque and rotation from the core barrel to the collar. Once the weight of the drill string is applied to the collar with the collar longitudinally restrained by the lower side of pocket 100, shear pin 52 will in fact shear off. At the same time, the core barrel 26 moves down relative to the collar 30 to disengage splined section 53, and the reaming collar 30 and core barrel 26 are disengaged from each other.

After the pin 52 has sheared and the splined section 53 has disengaged, the collar 30 is free to rotate with core barrel 26, subject to friction with the walls of pocket 100. Thus, the collar 30 is free to rotate under frictional force generated by the abrading means 36 on core barrel 26 passing through collar 30. Any milling effect on the interior of collar 30 itself is thus minimized.

The reaming collar 30 is provided with an abrading means 56, preferably over substantially all of its surface.

The power unit 32 houses a system for causing the deflection crank 34 to rotate, thus urging the core barrel 26, core bit 28 and reaming collar 30 against side wall 14 of bore hole 10 as part of the procedure to be described later.

Thus, the power unit 32 comprises a housing 60 within which are a hydraulic system 62 and a rack and pinion arrangement 64.

The hydraulic system 62 includes a hydraulic pump 66 driven by an electric motor 68 which is in turn preferably powered by a battery 70. A hydraulic fluid reservoir 72 is provided from which pump 66 draws required hydraulic fluid.

The hydraulic cylinder 74 contains a piston 76. Pump 66 is connected to cylinder 74 by hydraulic lines 78 and 80 for actuation of piston 76.

The piston rod 82 from piston 76 carries the rack 84. A shaft 86 carries pinion 88 in operative engagement with the rack 84.

The deflection crank 34 is also carried on and for rotation with the shaft 86.

A switch 94 for enabling a supply of power from battery 70 to motor 68 is mounted on the top 90 of housing 60 to be disposed under the open bottom 92 of bit 28. Thus, by directing drilling fluid through the bit 28 onto the switch 94, the switch 94 and thus motor 68 are switched on.

Similarly, switch 96 is mounted in operative engagement with the pinion 88, so that in one direction of rotation of the pinion, the switch will not operate but in the reverse direction the switch will operate to open the hydraulic fluid valve 69 to release pressure on piston 76.

Figure 2:
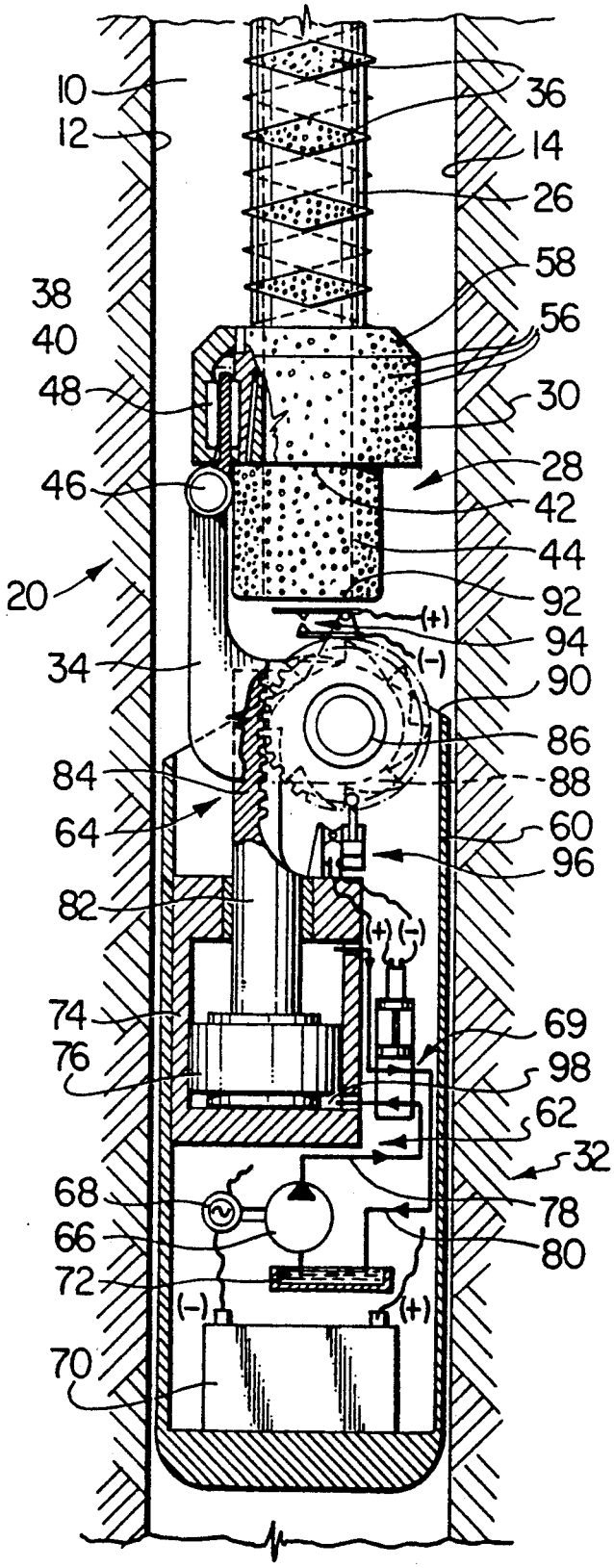
FIG. 2 is a partial section of a part of the assembly of FIG. 1 in the retracted position.
Figure 3:
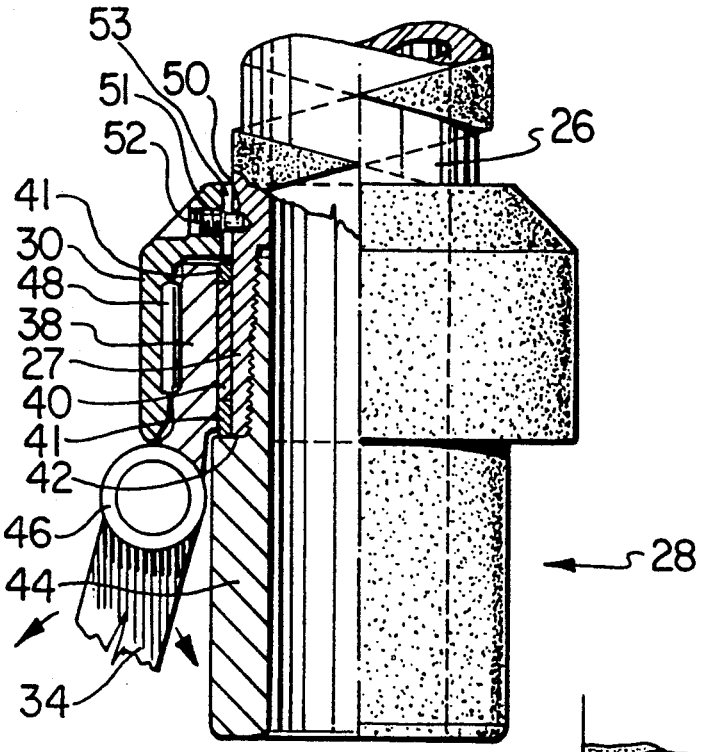
FIG. 3 is an enlarged view of a part of the assembly of FIG. 1.

In operation the assembly 20 is lowered to a predetermined level in a pre-existing bore hole 10. Drilling fluid is directed through the drill string to the bit 28 and hence to the switch 94 to turn on motor 68. Motor 68 then drives pump 66 to force hydraulic fluid via line 78 to the lower side 98 of piston 76. The piston rod 82 and hence the rack 84 are then driven, in terms of FIG. 2, upwardly. Rack 84 thus rotates pinion 88 which in turn causes the deflection crank 34 to rotate. The reaming collar 30, core bit 28 and core barrel 26 are then in turn forced against the wall 14 of bore hole 10. The drill string is simultaneously rotated so that the collar 30, bit 28 and barrel 26 mill their way into side wall 14 to form the pocket 100 in side wall 14.

Figure 4:
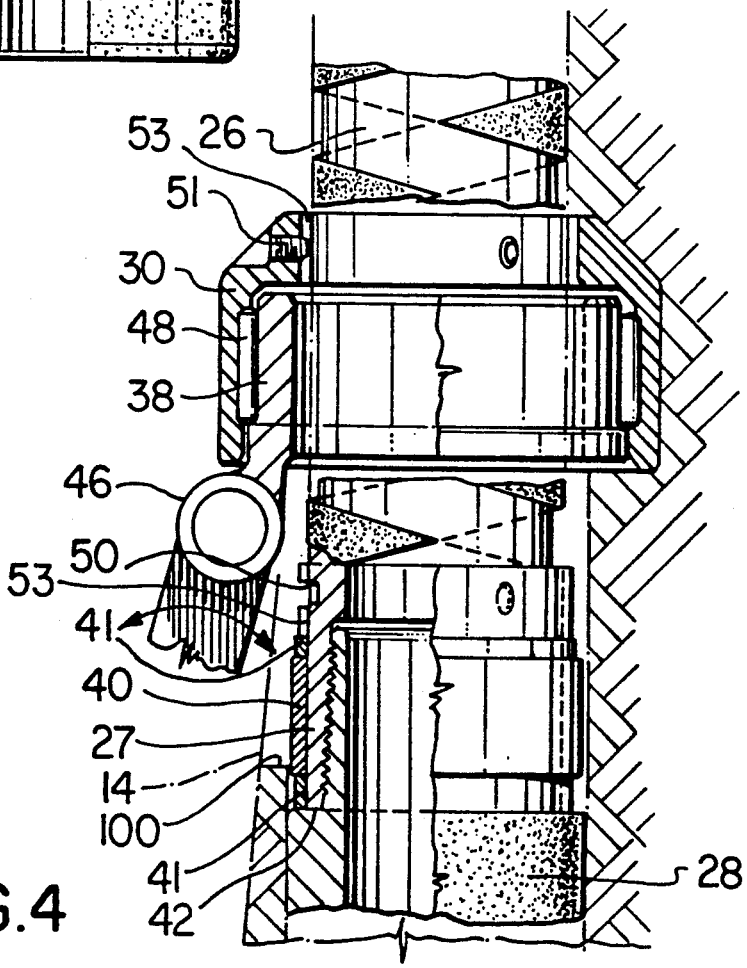
FIG. 4 is an enlarged view of a part of the assembly of FIG. 1 after coring has commenced.

Once the pocket 100 has been established, the drill string is lowered to commence coring. The pin 52 is sheared off so that the core barrel can move through ring 38 and collar 30 as coring progresses. The bit 28 begins to cut the core along bore hole 10 as illustrated in FIG. 1 in chain lines and in FIG. 4.

Once a core of sufficient length has been obtained, the drill string is raised to the point where the top 42 of core bit 28 brings up against the reaming collar 30/guide ring 38 assembly. Since the bit 28 cannot pass through the assembly, continued raising of the drill string causes the collar 30/ring 38 assembly to be pulled upwardly. The deflection crank 34 is thus caused to 15 begin to reverse the pinion 88. The switch 94 is thus thrown to relieve hydraulic pressure through valve 69. Pressure is then released from the lower side 98 of piston 76, allowing the crank to more readily rotate back into the axis of the bore hole to allow withdrawal of the entire assembly.

Thus it is apparent that there has been provided in accordance with the invention coring assembly for mounting on the end of a drill string that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claims as my invention:

1. A coring assembly for mounting on the end of a drill string and comprising:

a core barrel;

abrading means on at least a part of said core barrel;

a reaming collar mounted about a lower section of said core barrel and selectable between a first condition in which said collar is rotatable with said barrel and a second condition in which said collar is rotatable relative to and slidable longitudinally relative to said core barrel;

a housing suspended from said core barrel;

a deflection crank extending between said housing and said core barrel; and means within said housing for transferring power from a power source to said crank for selectively rotating said crank for moving said core barrel between a first position in which said core barrel and said housing are aligned and a second position in which said barrel and said housing are not aligned.

2. The assembly of claim 1 further comprising means for mounting said assembly on a drill string for rotation of the axis of said core barrel relative to the axis of said drill string.

3. The assembly of claim 2 wherein said means for mounting comprises a universal joint.

4. The assembly of claim 1 wherein said abrading means is applied in a pattern over substantially the length of said core barrel whereby, when said core barrel is rotated, substantially the entire length of said core barrel will cut a pocket into the wall of said bore hole.

5. The assembly of claim 4 wherein said abrading means is applied in a generally double spiral pattern along the length of said core barrel.

6. The assembly of claim 4 wherein said abrading means comprises strips comprising tungsten carbide granules in a matrix of nickel-copper alloy.

7. The assembly of claim 1 wherein said collar and said barrel include respectively a threaded bore and a slot which are aligned and contain a shear pin, and wherein in said first condition said pin is in place in said bores and in said second condition said pin is sheared off.

8. The assembly of claim 1 wherein said collar and said barrel are in said first condition interconnected by a short splined section and wherein in said second condition the respective collar and barrel parts of said splined section are disengaged.

9. The assembly of claim 1 further comprising a cylindrical guide ring slidably disposed about said core barrel and wherein a first end of said crank is hingedly attached to said ring.

10. The assembly of claim 9 wherein said reaming collar is disposed on said ring for rotation relative to said ring.

11. The assembly of claim 1 further comprising a power source within said housing.

12. The assembly of claim 11 wherein said power source is a battery.

13. The assembly of claim 1 wherein said means for transmitting power comprises a hydraulic system comprising an electric motor, a hydraulic pump driven by said motor, a hydraulic piston fed by said pump, a rack operatively connected to said piston, a pinion in operative relation to said rack and a shaft carrying said pinion.

14. The assembly of claim 13 further comprising means for remotely activating said motor.

15. The assembly of claim 14 wherein said means for remotely activating comprises a switch carried by said housing and disposed below the lower end of said core barrel for activation by drilling fluid flowing through said barrel.

16. The assembly of claim 13 further comprising means for remotely deactivating said motor.

17. The assembly of claim 16 wherein said hydraulic system includes a bypass valve between said pump and said piston and said means for remotely deactivating comprises a switch associated with said pinion for releasing pressure from said piston through said bypass valve responsive to the raising of said collar and consequent reversing of said pinion.

18. The assembly of claim 9 wherein said means for transmitting power comprises a hydraulic system comprising an electric motor, a hydraulic pump driven by said motor, a hydraulic piston fed by said pump, a rack operatively connected to said piston, a pinion in operative relation to said rack and a shaft carrying said pinion, and wherein a second end of said crank is secured to said shaft for rotation with said shaft.

* * * * *